United States Patent [19]

Beutler

[11] 4,011,851

[45] Mar. 15, 1977

[54] DISTRIBUTOR ASSEMBLY FOR A VEHICLE

[76] Inventor: Eden E. Beutler, 4830 Zube Court, Carmichael, Calif. 95608

[22] Filed: Aug. 25, 1975

[21] Appl. No.: 607,223

[52] U.S. Cl. ..... 123/146.5 A; 123/148 R; 200/27 A; 200/30 A

[51] Int. Cl.[2] ..... F02P 7/02

[58] Field of Search ..... 123/146.5 A, 117 A, 123/148 R; 200/19 A, 30 A, 27 A

[56] References Cited

UNITED STATES PATENTS

| | | | |
|---|---|---|---|
| 1,663,207 | 3/1928 | Mallory | 200/27 A |
| 1,792,072 | 2/1931 | Chryst | 200/31 V |
| 1,863,299 | 6/1932 | Davis, Jr. | 200/19 A |
| 2,016,076 | 10/1935 | Davis, Jr. | 200/19 A X |
| 2,176,164 | 10/1939 | Arthur | 200/19 A |
| 3,501,601 | 3/1970 | Cooksey | 200/31 V X |
| 3,776,211 | 12/1973 | Droke et al. | 123/146.5 A |
| 3,820,521 | 6/1974 | Longstaff-Tyrrell | 123/146.5 A X |

*Primary Examiner*—C. J. Husar
*Assistant Examiner*—Tony M. Argenbright
*Attorney, Agent, or Firm*—Mark C. Jacobs

[57] ABSTRACT

In a distributor assembly having a conventional cap with terminals therein and a conventional rotor assembly having a rotor shaft and vacuum advance mechanism, the improvement comprising a cartridge assembly housing disposed between the cap and the rotor assembly having a vacuum actuating pin engaging the vacuum advance mechanism and a connecting shaft inter-connecting the cap and the rotor shaft. The housing includes a conventional breaker point assembly, condenser and actuating cam therein and appropriate electrical connections. The cartridge assembly includes access therein for adjusting the point assembly and may be either permanently secured to the distributor cap or separable therefrom. In this manner, a vehicle owner can quickly and easily replace points and condenser in his vehicle without complicated equipment.

7 Claims, 5 Drawing Figures

FIG. 2
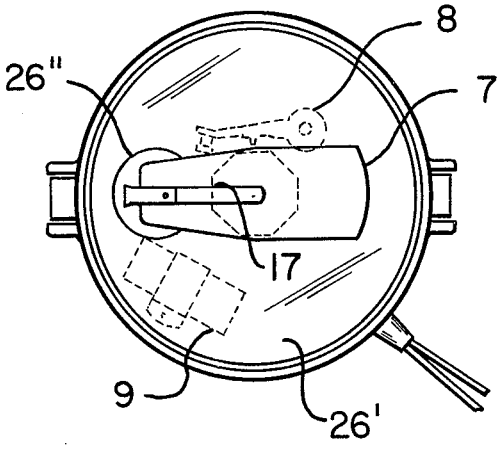
FIG. 3
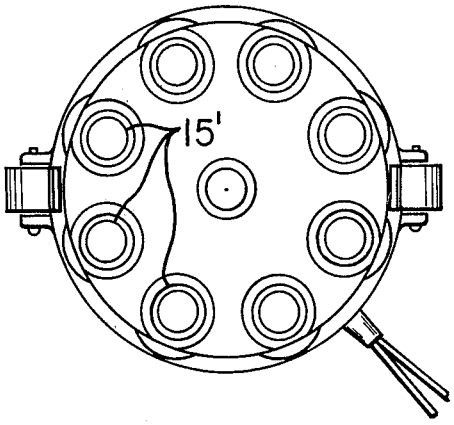
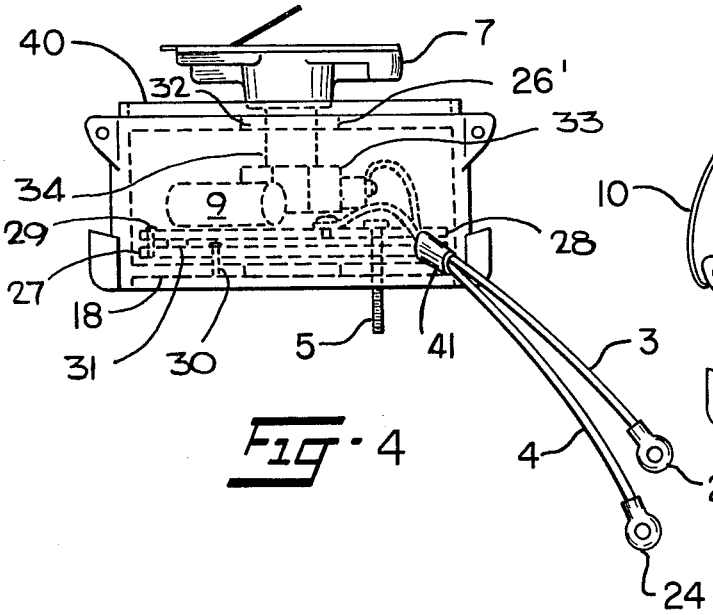
FIG. 4
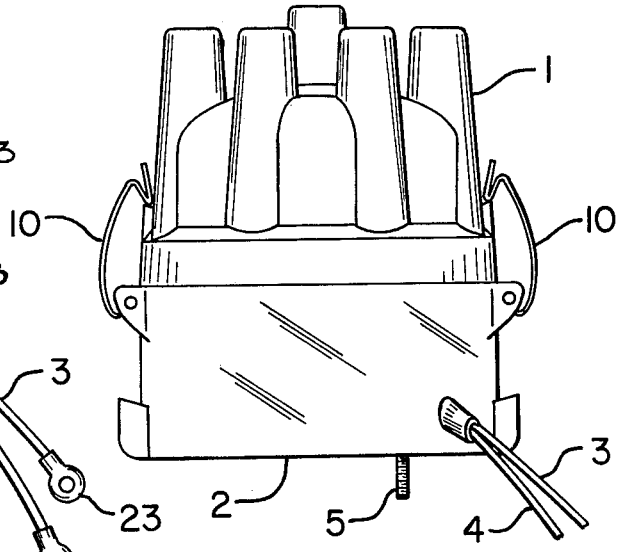
FIG. 5

DISTRIBUTOR ASSEMBLY FOR A VEHICLE

BACKGROUND OF THE INVENTION

1. Field of the Invention

This invention relates to automobile ignition systems, and particularly, to apparatus which is compatible with a standard distributor assembly for the replacement of the condenser and the points, and optionally the distributor cap.

2. Description of the Prior Art

The standard automobile distributor typically comprises a stator in the form of a cast housing, a support member, such as a plate, within the housing for carrying such elements as the breaker points, condenser and wiper, a rotor shaft which extends through the housing and through the support plate and a rotor assembly which is carried by the shaft. The breaker points which are mounted within the housing comprise a spring-biased arm carrying one of two metal electrodes which contact each other when an octagonal cam on the distributor shaft rotates past and in contact with the arm. In this manner, ignition timing pulses are generated in proportion to the engine speed.

Such prior art systems have been in existence and functioned properly until a tune-up was needed for years. It is well-known that, when tuning an engine, it is standard practice to replace the spark plugs, the points and the condenser — the latter two items being of interest here. The replacement is due to the deterioration that takes place from constant usage. The deterioration has an effect not only on gas mileage, a very important matter these days, but also on engine performance.

In the past, it was quite difficult for the do-it-yourself vehicle owner to give his car a tune-up without making a capital investment in a timing light and a dwell meter. These items were considered necessary for setting the proper timing. Also, the setting of the proper gap width, in thousandths of an inch, requires a great deal of skill.

In order to negate the requirement of capital investment, and a great deal of skill and patience, the instant invention has been developed to allow the vehicle owner to quickly and easily replace the condenser and points of his engine and re-install the same with absolute accuracy.

SUMMARY OF THE INVENTION

It is an object of this invention to provide a low-cost, simple to install, pre-packaged points and condenser system to replace the original equipment or previously replaced points and condenser.

In general, the invention comprises a cartridge of generally cylindrical shape, of metal or plastic or a combination thereof, with a top horizontal plate and a bottom horizontal plate, parallel to each other and at right angles to an upstanding wall of the cartridge. Two apertures, one per plate, are provided in vertical alignment. A vertical shaft is positioned in the plate apertures, and is held in place by a support bearing positioned on the inward facing side of the top plate. Suitably positioned, as is known to the art, is an octagonally shaped cam on the shaft. This cam operates to open and close the mechanical breaker points to be described below. Mounted in a spaced parallel arrangement to the bottom plate is a weight plate. The weight plate contains a slotted aperture in vertical alignment with a similar aperture in the bottom plate. Partially secured and spaced from the weight plate is a contact plate. The breaker points and condenser are secured in a rigid manner to the contact plate. A replacement rotor cap or the previously used one is mounted on the shaft of the cartridge in conventional manner. The lower portion of the shaft of the cartridge is adapted to mount on the top portion of the existing distributor shaft by engagement. An activating pin positioned vertically from the contact breaker plate extends vertically through the aligned slotted apertures. This pin engages the vacuum advance plate of the housing and from which the original equipment points and condenser are removed, whereby the vacuum advance can operate in conventional manner. Mounted on the breaker plate are the condenser, and a pair of pre-set breaker points which ride against the vertical center shaft cam in a manner duplicating their operation in prior art apparatuses. The breaker plate is configured to match the original equipment vacuumm advance plate, at least in operation, if not in shape. The breaker points and condenser are of conventional design and need not be discussed further.

The distributor cap is placed in superposed axial alignment on the top portion of the cartridge, such that the top plate projects into the distributor cap housing, the top plate having an outside diameter substantially equal to the inside diameter of the lip portion of the cap. In another embodiment, the distributor cap forms an integral piece with the side wall of the cartridge, thus eliminating the necessity of the top plate. This would also do away with the conventionally used locking spring clips which are used to secure, in a removeable fashion, the cap to the cartridge.

It is an object, therefore, to provide a replaceable tune-up cartridge with factory pre-set points.

It is another object to provide a means of installing a set of points without a large capital investment for special lights, meters and gapping tools.

It is a further object of this invention to provide a means for the average consumer to replace his points and condenser with no prior training.

In order that the invention in all its aspects may be fully understood, reference is made to the accompanying drawings.

BRIEF DESCRIPTION OF THE DRAWINGS

FIG. 2 is a top plan view of the cartridge of the instant invention with the shaft, condenser and points shown in dotted lines;

FIG. 3 is a top plan view of the cartridge of FIG. 2 with, the contact terminals of distributor cap vertical, shown in operative position;

FIG. 4 is a vertical, side view of the cartridge of FIG. 2, and FIG. 5 is a vertical, side view of the cartridge of FIG. 2 with the distributor cap positioned thereon.

DESCRIPTION OF THE PREFERRED EMBODIMENT

Figure 1:
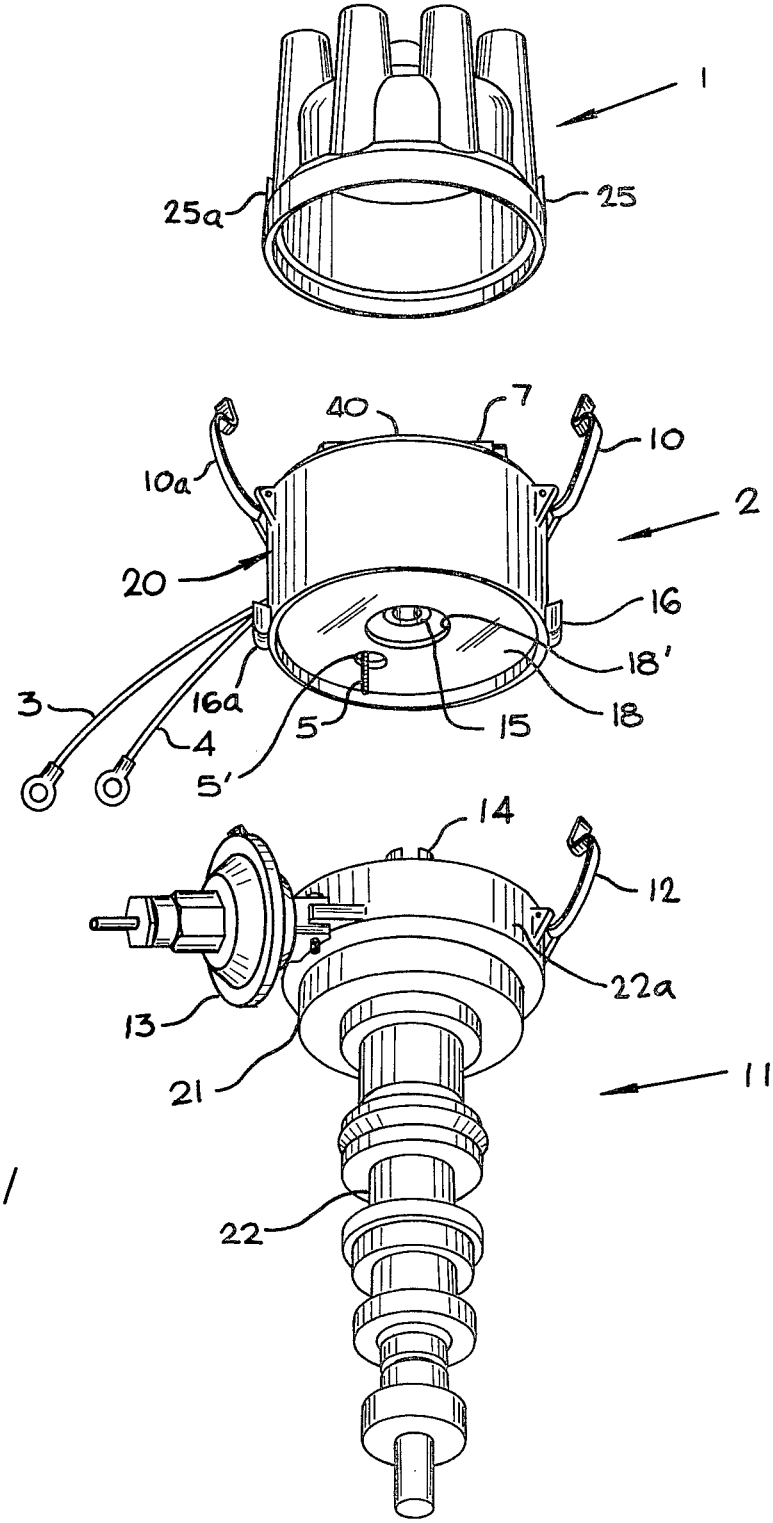
FIG. 1 is an exploded view of an electrical distributor assembly embodying the instant invention.

Referring to FIG. 1, there is shown a distributor assembly 11 for an automotive ignition system and comprising a housing 21 and a shaft assembly 22 which is rotatable relative to the housing 21 about a longitudinal vertical axis. Horizontally positioned and affixed to the housing 21 is a conventional vacuum advance assembly 13.

At the upper or inner end of the rotor shaft assembly 22, a portion of reduced diameter, namely 14, extends through the housing 21 and rotates with an octagonal cam 33 (see FIG. 4), which operates to open and close the mechanical breaker points (shown in dotted lines in FIG. 2) in a standard distributor assembly, but which in this invention engages collar 15, to form an extended shaft assembly particularly to operate the breaker points present in cartridge 2, as seen particularly in FIG. 2, and the rotor 7 mounted therein (see also FIGS. 2 and 4).

Cartridge 2 comprises a cylindrical housing having an upstanding wall 20, a bottom annulus-shaped plate 18 with the annular bore 18' having collar 15 suspended therein and held in place by bearings or other retaining means, not shown, the collar 15 being in longitudinal alignment to engage shaft section 14.

Aperture 5' is suitably positioned on the bottom plate 18 such that a vacuum activating pin 5 is adapted to engage the vacuum advance mechanism 13 in conventional manner. Pin 5 is a partially threaded screw which connects points assembly 8 (see also FIG. 2) to breaker plate 28 (FIG. 4) and which protrudes through a pair of aligned apertures to engage vacuum advance assembly 13 as is known in the art.

Suitably positioned, preferably 180° apart, are flanges 16, configured to engage retaining clips 12 whereby the cartridge 2 is held position in superposed relationship to the housing 21. In the preferred embodiment plate 18 is recessed slightly into wall 20, and the diameter of wall 20 is set slightly larger than the inner diameter of the upper housing **22*a* of housing 21 of the shaft assembly 22, such that upon engagement of one with the other, the inner wall of wall 20 will overlap and be in contact with a circular portion of the top of the housing 21, portion 22*a***.

Emerging from an opening in the upstanding side wall are a pair of wires 3 and 4, which may be color-coded, such as one black and one white, preferably with connectors 23, 24 thereupon at the protruding ends. The connectors 23, and 24, respectively, may be used to connect the points to the coil and the cartridge 2 to ground, as is well known.

Suitably positioned on the cartridge 2, usually in vertical alignment with flanges 16 and **16*a*, are spring clips 10 and 10*a*. These are mounted in any conventional manner, and are adapted for engagement with flanges 25 and 25*a* of a conventional distributor cap 1**.

Top plate 26 (FIG. 2) may be positioned to have its under surface abut the upper peripheral edge of wall 20, or the plate 26 may be recessed into the interior of wall 20, or it may protrude beyond the upper peripheral edge of wall 20, when the plate 26 is positioned in register with the wall 20.

Rotor arm 7 (see also FIG. 2) generally may be positioned in only one mode upon the upper end of assembly 15, which shaft assembly 15 protrudes through an aperture 26' (see FIG. 4) in the center of plate 26, in alignment with the central aperture 18' of plate 18. Rotor arm 7 is provided with a resilient contact 17 (FIGS. 2 and 4) which contacts a spaced contact terminal 15', shown in FIG. 3, wherein they are seen to eight in number and positioned on the interior of the cap 1. The cap 1 may be mounted on the body of the distributor assembly 11 in register therewith, and retained in position by means of the spring clips 10 and **10*a* engaging flanges 25, 25*a*, respectively. A set of points 8 and a condenser 9 are mounted on the top surface of plate 19, as shown in FIG. 2**.

In an alternative embodiment, posts 25 and **25*a*, and clips 10 and 10*a* may be omitted and the cap may be pre-attached to the cartridge 2 at the factory, as by adhesion using a suitable cement, after the remainder of the cartridge is assembled. This embodiment is not shown since it would be identical to FIG. 5 save for the elimination of posts 25, 25*a* and clips 10, 10*a***.

As discussed, the vacuum advance plate assembly 13 includes a plate recessed into housing 21 which is engaged by pin 5 for operation thereof, which is well-known in the art. This forms no part of the invention and further description is deemed unnecessary.

FIG. 4 shows the wires 3 and 4 with connectors 23 and 24 thereon, respectively. Bottom plate 18 is shown to be recessed into and secured to side wall 20, such as by the use of an adhesive. Fixedly secured to the bottom plate, which need not be recessed as discussed, is the weight plate 27. This is secured by a plurality of screws and associated nuts, all denoted as 30, and is spaced apart therefrom.

Contact breaker plate 28 is pivotally connected to weight plate 27, and spaced therefrom by a plurality of spacer members, with which it is in contact with, and in a horizontal plane to the weight plate 27. Again, these parts are conventional and need not be discussed further.

One of the connecting screws, 30, may be utilized as a ground-lug, and is seen to be the attachment point for fround wire 4, as well as for a ground connection between the breaker plate 28 and the weight plate 27.

Mounted on the breaker plate 28 is a breaker point assembly 8, and a condenser and condenser holder 9 (see also FIG. 2).

Top plate 26, as heretofore discussed, is positioned at substantially right angle to the upstanding side wall 20, and spaced apart from contact with any other component of cartridge 2. The top plate 26 contains a central bore 26' and an optional aperture 26'' (see FIG. 2) in vertical alignment with the screw utilized to adjust the breaker points of assembly 8.

Rotor shaft or collar 15 is of conventional design and secured to the top plate 26 by a mounting bearing 32. The shaft or collar 15 protrudes through the central bore 26' and is positioned at right angles to the top plate 26. The amount of protrusion is sufficient only to allow the rotor 7 to be mounted thereon in close proximity to the top plate 26. This shaft or collar 15 extends the length of the inside of the cartridge 2 and has the octagonally shaped cam 33 mounted thereon, as in a conventional distributor arrangement, the cam 33 being positioned vertically between the bearing 32 and the breaker plate 28. Shaft or collar 15 may be comprised of interconnected sections as is well known in the art.

Shaft or collar 15 thus includes a slotted lower end forminng a slotted coupling on the underside of cam 33, as shown in FIG. 1. As indicated previously, the slotted coupling engages distributor shaft 14 to provide a rotative motion to rotor 7. Needless to say, the nature of the connection between 14 and 15 may be altered so long as the desired result is achieved.

Wire 3, shown to be exiting through a grommet 3' in FIG. 4, is the connector from the condenser 9.

While the top and bottom plates are disclosed to be adhesively connected, it may be readily seen that any securing arrangement is contemplated to be used in conjunction with an adhesive or in replacement thereof, so long as the proper spatial relationship is maintained.

The upstanding side wall 20 and the top and bottom plates 26 and 18 of the cartridge 2 may be all made of either plastic or metal or a combination thereof. Optionally, a rubber or other suitable sealing strip (not shown) may be provided on the housing 21 or the cartridge 2 at their surface interface and at the interface of the distributor 1 with the cartridge 2 to impede the ingress of moisture and dirt.

All of the components utilized in the cartride 2 are specifically chosen to be compatible with the original factory equipment of the particular brand of car, by year and model number, where the cartridge 2 is to be employed. Thus the specification of, for example, the condenser 9, would match the specifications of the condenser 9 that is being replaced.

In the same vein, the breaker points that are installed in the cartridge 2 are intended to be pre-set at the factory to match the factory specifications, including the proper gap.

The breaker points and condenser may be placed beneath the top plate 26 where they are free from access by the consumer. Thus the integrity of the gap setting done by the factory is preserved. Continuing in this vein, it is seen that a prescored line may be circumscribed on the top plate 26, such that on removal of the circumscribed area, an aperture is formed, and that an aperture is formed when the pre-scoring is fully scored. Through this aperture, which should be positioned for direct access to the breaker points, and which will vary for make and model car, proper tools may be utilized to maximize or fine tune the gap. This pre-scored portion is shownin FIG. 2 and thus opening 26″ may be eliminated, if desired. Thus, the points and condenser may be mounted as shown in FIG. 4 or directly onto the underside of top plate 26. Since such a view would be identical to that of FIG. 2, no further illustration is deemed necessary.

Thus, there is provided a tune-up cartridge for a spark ignition internal combustion engine, which engine may be fitted with replacement contact points in a minimum of time and with none of the trouble and inconvenience involved with which one may be familiar in such replacement under prior art conditions. Thus the necessity of a feeler gauge is eliminated. One will not lose the small screws necessary to re-install new breaker points, as often happens.

Additionally, in one preferred embodiment, the possibility of moisture reaching the rotor contact points is eliminated, when such is preassembled or pre-moulded to the cartridge.

It is also seen that in one embodiment, that moisture is prevented from entering the points area, causing malfunction of the car's operation.

In tests on a late model U.S. car, it was found that the tuneup time attributable to changing the points and condenser was lowered from the normal 45 to 60 minutes, to about 10 minutes; and, that no tools other than those in the average homeowner's garage were needed to accomplish the job.

It is seen that there can be an optional circular lip 40 whose outside dimensional radius is equal to the inside radius of the upstanding side wall 20. This lip's wall thickness abuts the top plate 26, and serves to prevent lateral movement of the cap 1, when such is placed into position, as a separate non-integrated unit.

It is seen in retrospect that the tuneup cartridge of this invention can have its shaft's lower portion engage the top portion of the present distributor shaft by any known means of engagement. Thus the cartridge can either internally or externally engage the distributor shaft. Therefore the cartridge may be inserted into the keyway of the distributor shaft. While not necessarily recommended, it is also to be seen that an intervening keying mechanism, perhaps with a plurality of splines could be interposed between the two shafts, so afford the desired connection.

While the embodiments discussed above all relate to the use of but one set of points and one condenser, it is to be seen that tuneup cartridges bearing a plurality of points and/or condensers can be prepared and are within the scope of this invention. Such dual systems are considered advantages toward the attainment of a high performance spark.

Since certain changes may be made in the above apparatus without departing from the scope of the invention herein involved, it is intended that all matter contained in the above description and shown in the accompanying drawings shall be interpreted as illustrative and not in a limiting sense.

I claim as my invention:

1. In a distributor assembly for a vehicle including a distributor cap having a plurality of spaced contact terminals internally thereof and a rotor shaft assembly having a vacuum advance mechanism adapted to be engaging by a vacuum advance actuating pin and an upper housing assembly operatively connected to said vacuum advance mechanism with a rotor shaft axially extending through said rotor shaft assembly adapted to be connected to the lower end of a connecting shaft, and a rotor adjusted to be removably secured to the upper end of said connecting shaft, the improvement which comprises:

a removable cartridge assembly including a housing having an outer wall and closed at one end by a top wall and the lower end by a bottom wall and having said connecting shaft axially extending therethrough and rotatable therein, said connecting shaft extending through said top wall and having rotor connecting means at its upper end for fixedly and removably securing said rotor thereto for rotation therewith in a predetermined orientation and accessible through said bottom wall and having a rotor shaft connecting means at its lower end for fixedly and removably securing said rotor shaft thereto for rotation therewith, said cartridge assembly further including first distributor cap connecting means associated with said housing for fixedly and removably securing said cartridge assembly to said distributor cap and second connecting means associated with said housing for fixedly and removably securing said cartridge assembly to said rotor shaft assembly, said cartridge assembly further including said vacuum advance actuating pin therein extending through said bottom wall and having its lower end operatively engaging said vacuum advance mechanism when said cartridge assembly is connected to said rotor shaft assembly, said rotor selectively engaging said contact terminals when said cartridge assembly is connected to said distributor cap, said cartridge assembly further including a cam rotatably connected to said connecting shaft internally of said housing between said top and bottom walls, and a breaker point assembly mounted internally of said housing and breaker point assembly actuating means associated with both said cam and said breaker point assembly for actuating said breaker point assembly when said cam is rotated, the upper end of said vaccum advance actuating pin being operatively connected to said breaker point assembly, and a pair of electrical connecting means, one of said electrical connecting means being operatively connected at one end to said breaker point assembly and having its free end extending out of said cartridge assembly and the other of said electrical connecting means being operatively connected at one end to said cartridge assembly and having its free end extending to a point remote from said cartridge assembly.

2. In the improvement in the distributor assembly of claim 1 wherein said breaker point assembly includes breaker contact points mounted in a breaker contact plate mounted in said housing with said points spaced from said top and bottom walls.

3. In the improvement in the distributor assembly of claim 1 including breaker point assembly access means associated with the top wall of said housing for providing access to said breaker point assembly externally of said housing.

4. In the improvement in the distributor assembly of claim 1 wherein said first connecting means includes a first pair of spaced resilient clips pivotally mounted at predetermined locations on said housing and a first pair of spaced flange means mounted at predetermined locations on said distributor cap for receiving said first clips in locking engagement therewith and a second pair of spaced resilient clips pivotally mounted at predetermined locations on said rotor shaft assembly and a second pair of spaced flange means mounted at predetermined locations on said cartridge assembly for receiving said second clips in locking engagement therewith.

5. In a distributor assembly for a vehicle including a rotor shaft assembly having a vacuum advance mechanism adapted to be engaging by a vacuum advance actuating pin and an upper housing assembly operatively connected to said vacuum advance mechanism with a rotor shaft axially extending through said rotor shaft assembly adapted to be connected to the lower end of a connecting shaft, and a rotor adapted to be removably secured to the upper end of said connecting shaft, the improvement which comprises:

a distributor cap having a plurality of spaced contact terminals internally thereof fixedly secured to a cartridge assembly including a housing having an outer wall and closed at the lower end by a bottom wall and having said connecting shaft axially extending therethrough and rotatable therein, said connecting shaft having rotor connecting means at its upper end for fixedly and removably securing said rotor thereto for rotation therewith in a predetermined orientation and accessible through said bottom wall and having rotor shaft connecting means at its lower end for fixedly and removably securing said rotor shaft thereto for rotation therewith, said cartridge assembly further including first distributor cap connecting means associated with said housing for fixedly and removably securing said cartridge assembly to said distributor cap and second connecting means associated with said housing for fixedly and removably securing said cartridge assembly to said rotor shaft assembly, said cartridge assembly further including said vacuum advance actuating pin therein extending through said bottom wall and having its lower end operatively engaging said vacuum advance mechanism when said cartridge assembly is connected to said rotor shaft assembly, said rotor selectively engaging said contact terminals when said cartridge assembly is connected to said distributor cap, said cartridge assembly further including a cam rotatably connected to said connecting shaft internally of said housing between said top and bottom walls, and a breaker point assembly mounted internally of said housing and breaker point assembly actuating means associated with both said cam and said breaker point assembly for actuating said breaker point assembly when said cam is rotated, the upper end of said vacuum advance actuating pin being operatively connected to said breaker point assembly, and a pair of electrical connecting means, one of said electrical connecting means being operatively connected at one end to said breaker point assembly and having its free end extending out of said cartridge assembly and the other of said electrical connecting means being operatively connected at one end to said cartridge assembly and having its free end extending to a point remote from said cartridge assembly.

6. In the improvement in the distributor assembly of claim 5 wherein said breaker point assembly includes breaker contact points mounted in a breaker contact plate mounted in said housing with said points spaced from said wall.

7. In the improvement in the distributor assembly of claim 5 wherein said housing is secured in a relatively leakproof-type manner to said distributor cap and said second connecting means includes a pair of spaced flange means mounted at predetermined locations on said distributor cap for receiving a pair of spaced resilient clips on said rotor shaft assembly in locking engagement therewith.

* * * * *